US005928047A

United States Patent [19]

Ishibashi et al.

[11] Patent Number: 5,928,047

[45] Date of Patent: Jul. 27, 1999

[54] PLANAR MEMBER FOR SHADOW MASK OF CATHODE-RAY TUBE AND MANUFACTURING METHOD OF SHADOW MASK

[75] Inventors: Mayumi Ishibashi; Jun Araya, both of Osaka; Takami Okamoto, Kyoto, all of Japan

[73] Assignee: Matsushita Electronics Corporation, Osaka, Japan

[21] Appl. No.: 08/853,404

[22] Filed: May 9, 1997

[30] Foreign Application Priority Data

May 15, 1996 [JP] Japan ..... 8-119877

[51] Int. Cl.[6] ..... H01J 9/20

[52] U.S. Cl. ..... 445/30; 445/47

[58] Field of Search ..... 445/30, 47

[56] References Cited

U.S. PATENT DOCUMENTS 4,767,962 8/1988 Adler et al. ..... 313/402
4,942,333 7/1990 Knox ..... 313/402
5,364,340 11/1994 Coll ..... 604/8
5,396,145 3/1995 Shiohara et al. ..... 313/402
5,620,127 4/1997 MacKenzie ..... 224/555

*Primary Examiner*—Sandra O'Shea
*Assistant Examiner*—Gene H. Rhodes
*Attorney, Agent, or Firm*—Merchant, Gould, Smith, Edell, Welter & Schmidt, P.A.

[57] ABSTRACT

A planar member for a shadow mask is provided, which is hard to generate wrinkles in or break when being pulled at four sides to apply a tension to a beam-selecting area with beam-passing apertures. The planar member comprises the beam-selecting area, a first band frame portion surrounding the beam-selecting area, a second band frame portion disposed around and spaced from the first band frame, a plurality of bridge portions bridging the first and second band frame portions at plural points, and a plurality of outer areas with plural apertures, defined by the first and second band frame portions and two bridge portions. The connecting part of the bridge portion with the second band frame portion is reinforced in such a way that the width of the bridge portion increases gradually to connect with the second band frame portion.

13 Claims, 8 Drawing Sheets

PLANAR MEMBER FOR SHADOW MASK OF CATHODE-RAY TUBE AND MANUFACTURING METHOD OF SHADOW MASK

BACKGROUND OF THE INVENTION

The present invention relates to a planar member for a shadow mask of a cathode-ray tube and a method for manufacturing a shadow mask using the planar member.

As illustrated in FIG. 7, a color cathode-ray tube 1 with a flat face includes a glass panel 2 having a substantially flat face screen 3. Panel pins 5 are attached to the inner surface of the glass panel 2, for supporting a metal frame member 7 for a shadow mask 9. Plate springs 8 attached to the outer surface of the frame member engages the panel pins 5, so that the shadow mask 9 stretched on the frame member 7 is fixed at a predetermined position in the glass panel 2. Electron beams 10 emitted by an electron gun (not shown in the Figure) pass apertures of the shadow mask 9 and hit corresponding spots of a fluorescent screen 4 formed on the inner face of the glass panel 2.

Some electron beams do not pass the apertures but hit the shadow mask 9. Consequently, the shadow mask is heated and may suffer a thermal expansion. If the shadow mask is deformed by the thermal expansion, color purity may be deteriorated when the electron beam mishits a proper spot of the fluorescent screen after passing through the aperture at a deformed portion of the shadow mask. In order to suppress the deformation of the shadow mask due to the thermal expansion, the shadow mask 9 is usually given a certain tension by welding while being stretched on the frame member 7.

In the prior art, a planar member 21 shown in FIG. 8 was used for stretching and welding the shadow mask 9 on the frame member 7. This planar member 21 includes a beam-selecting area 22 with a lot of small slots or apertures for passing an electron beam, which are disposed at a predetermined pitch and pattern, and an area 23 without apertures surrounding the beam-selecting area 22. The beam-selecting area 22 has a substantially rectangular shape to be a shadow mask.

The beam-selecting area 22 is positioned on the frame member 7, and a tension is applied to the beam-selecting area 22 by pulling the four sides of the planar member 21, i.e., the area without apertures. Then the planar member is welded to the frame member 7. The area without apertures 23 is cut off along the outer rim of the frame member 7. Thus, a shadow mask assembly, i.e., a color selecting electrode is manufactured.

As mentioned above, the beam-selecting area has a lot of apertures and the surrounding area 23 has no aperture. Therefore, there is a big difference in tensile strength between the beam-selecting area 22 and non-aperture area 23. Consequently, when the four sides of the planar member 21 are pulled outward by a predetermined force, the extension amount is different between the beam-selecting area 22 and the non-aperture area 23, resulting in a wrinkle being generated at corners (24 in FIG. 8) of the beam-selecting area. The wrinkle in the beam-selecting area 22, which is to be a shadow mask, may cause a deterioration of color purity since correspondence of the beam passing aperture and the spot on the fluorescent screen may shift at the wrinkled portion.

Another problem of the prior art is that the boundary portion of the beam-selecting area 22 and the non-aperture area 23 has a tendency to break when the four sides of the planar member 21 are pulled to the outside. As a result, it is difficult to raise a yield rate in the manufacturing process.

SUMMARY OF THE INVENTION

The planar member for a shadow mask according to the present invention comprises the beam-selecting area having a plurality of beam-passing apertures arranged at a predetermined pitch and pattern, a first band frame portion enclosing the beam-selecting area, a second band frame portion disposed around and spaced from the first band frame, a plurality of bridge portions bridging the first and second band frame portions at plural points, and a plurality of outer areas with plural apertures, defined by the first and second band frame portions and two bridge portions. The connecting part of the bridge portion with the second band frame portion is reinforced in such a way that the width of the bridge portion increases gradually to connect with the second band frame portion.

The method for manufacturing a shadow mask according to the present invention comprises the steps of preparing the above-mentioned planar member, applying a tension to the planar member by pulling the four sides of the planar member outward, welding the first band frame portion of the planar member to a metal frame member, and removing the outer part of the planar member around the welded portion.

According to the present invention using the above-mentioned planar member and method, the outer area with dummy apertures around the beam-selecting area can be adjusted to have the same tension stress as the beam-selecting area. As a result, when the four sides of the planar member are pulled outward to apply a tension to the planar member, the deformation amounts of the beam-selecting area and its surrounding area become substantially equal so that the generation of wrinkles at four corners of the beam-selecting area can be suppressed. In addition, stress concentration at the connecting part of the bridge portion with the second frame member is relieved and breakage of the planar member is avoided when the four sides of the second band frame portion are pulled outward to apply a tension to the planar member, since the connecting part of the bridge portion with the second band frame portion is reinforced in such a way that the width of the bridge portion increases gradually to connect with the second band frame portion. The width of the bridge portion may increase linearly or along an arc line or similar curve.

It is preferable that the first and second band frame portions have substantially rectangular inner and outer rims, and substantially rectangular outer corner areas with plural apertures are defined by the second band frame portion and two bridge portions. Alternatively, the first band frame portion has substantially rectangular inner and outer rims, the second band frame portion has substantially octagonal inner and outer rims, and substantially triangular outer corner portions with plural apertures are defined by the second band frame portion and two bridge portions. Thus, when four sides of the second band frame portion are pulled outward to apply a tension to the planar member, a tension imbalance is avoided between the middle and ends in each side of the rectangular beam-selecting area.

It is also preferable that the size of the plural apertures in the outer areas is smaller in the area near to the second band frame portion than the area near to the first band frame portion. Thus, a uniform tension is applied to the whole area of the beam-selecting area by varying the size of the aperture arranged in the outer area at a predetermined pitch.

DETAILED DESCRIPTION OF THE PREFERRED EMBODIMENTS

First Embodiment

Figure 1:
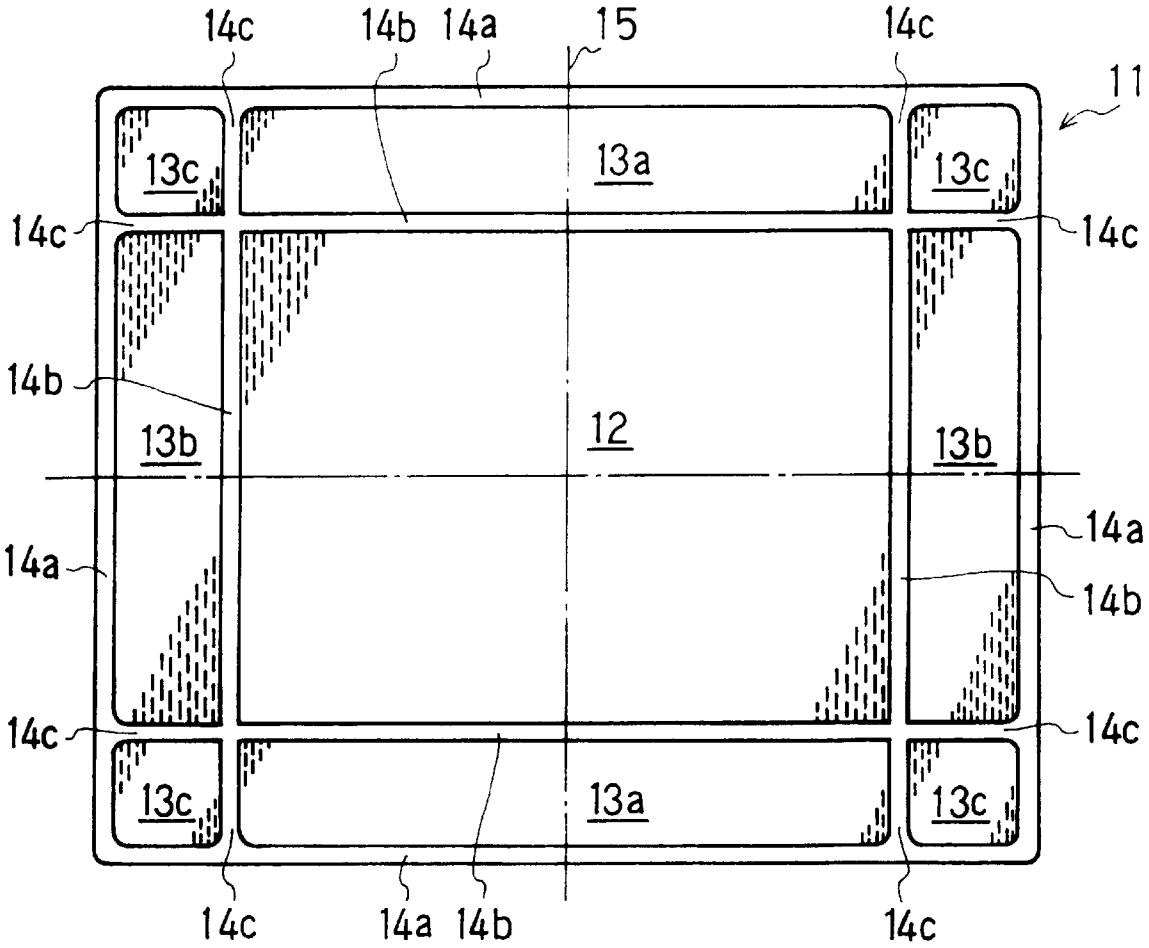
FIG. 1 is a plan view of a planar member for a shadow mask according to a first embodiment of the present invention.

FIG. 1 shows a planar member 11 for a shadow mask according to a first embodiment of the present invention. The planar member 11 includes a beam-selecting area 12 having a rectangular shape, a first band frame portion 14*b* surrounding the beam-selecting area 12, and a second band frame portion 14*a* disposed around and spaced from the first band frame. The first band frame portion 14*b* and the second band frame portion 14*a* are connected to each other via plural bridge portions 14*c*.

There are outer areas 13*a*, 13*b* and 13*c* defined by the first and second band frame portions 14*b*, 14*a* and bridge portions 14*c*. These outer areas 13*a*, 13*b* and 13*c* have a lot of small slots or apertures arranged at a predetermined pitch and pattern similarly to the beam-selecting area 12. The slots or apertures in the beam-selecting area are for the electron beam to pass through, while the slots or apertures in the outer areas 13*a*, 13*b*, 13*c* are disposed so that a uniform tension can be applied to the entire portion of the beam-selecting area.

Figure 4:
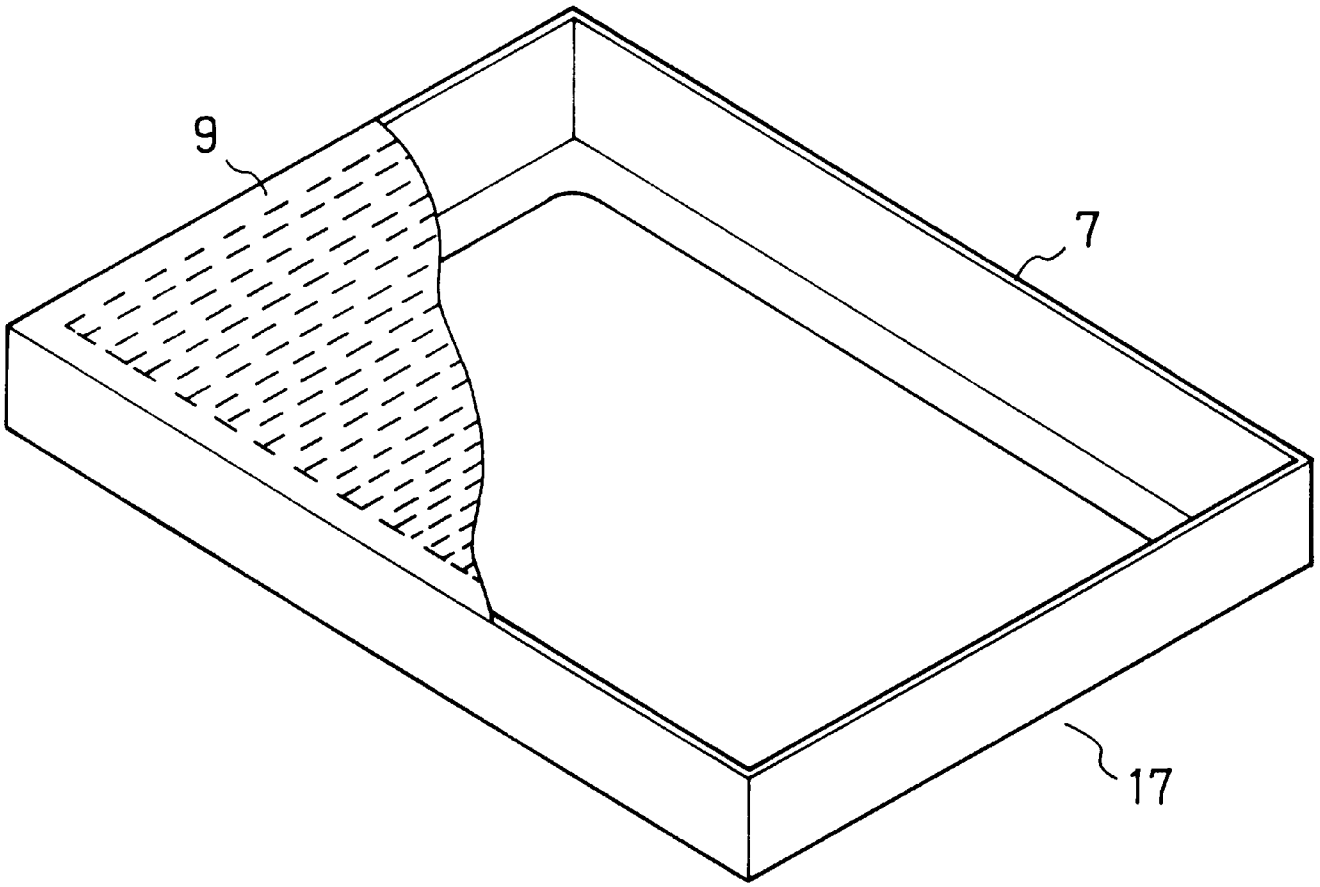
FIG. 4 is a perspective view of a shadow mask assembly (color selecting electrode) according to the present invention.
Figure 7:
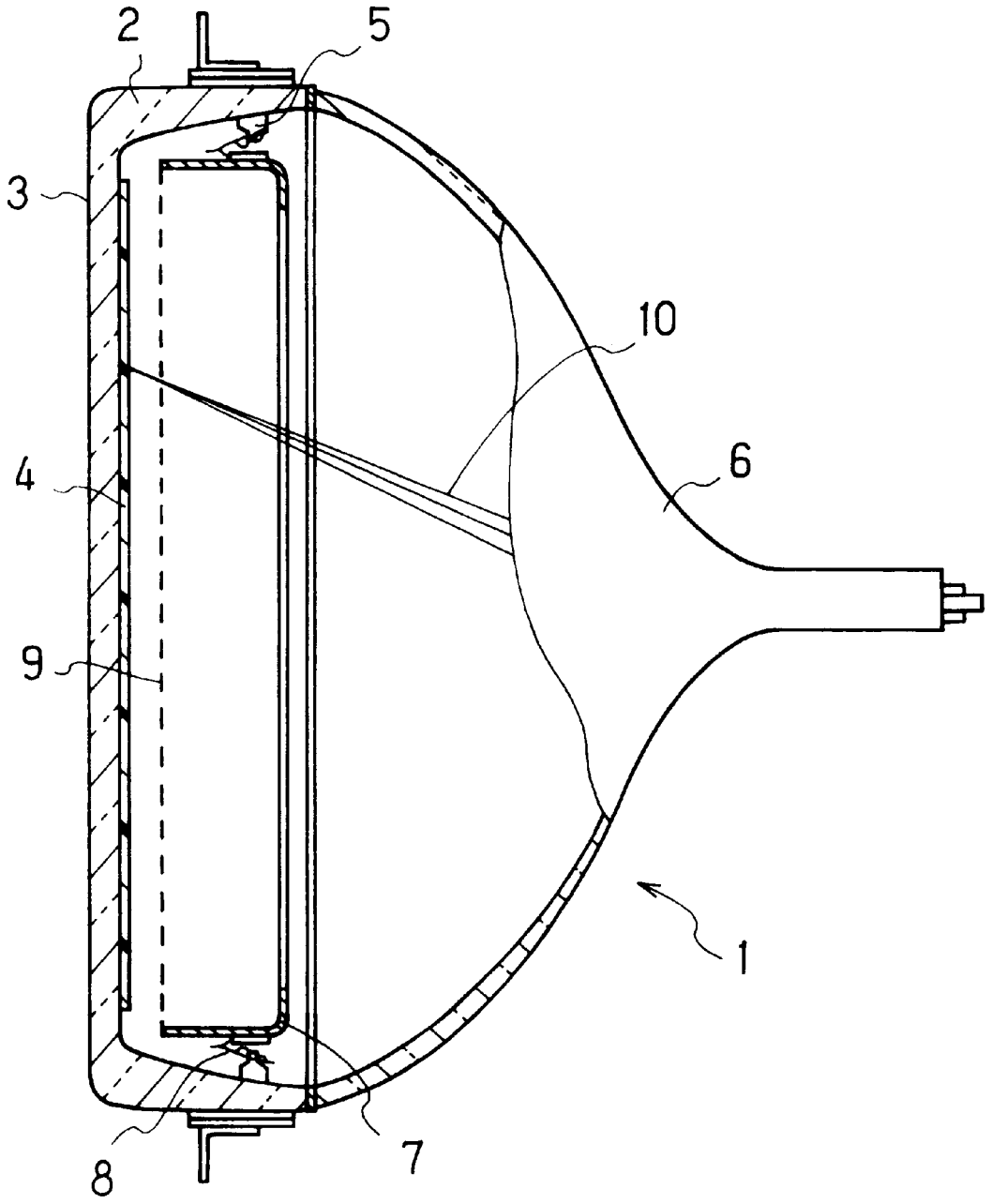
FIG. 7 shows a partial section of a color cathode-ray tube that uses a planar member for a shadow mask according to the present invention.
Figure 8:
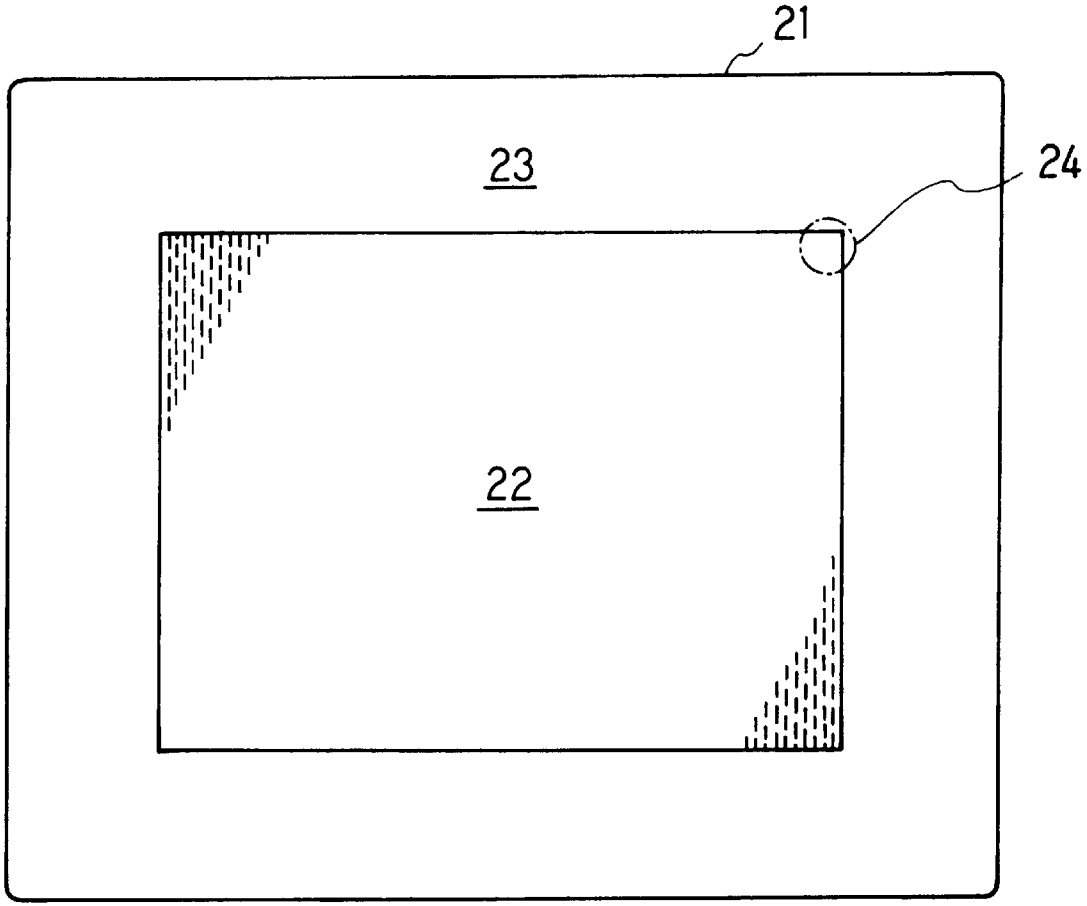
FIG. 8 (PRIOR ART)
FIG. 8 is a plan view of a planar member for a shadow mask in the prior art.

Four sides of the second band frame portion 14*a* of the above-mentioned planar member 11 are engaged by a tool (not shown in the Figure) and pulled outward, so that a tension is applied to the entire portion of the planar member 11. Then the first band frame portion is positioned and welded to the frame member (7 in FIG. 4). The outer portion of the welded portion, i.e., the outer areas 13*a*, 13*b*, 13*c*, bridge portion 14*c* and the second band frame portion 14*a* are cut off. Thus a shadow mask assembly (i.e., a color selecting electrode) 17 is obtained. This color selecting electrode 17 is fixed to the inner face of the glass panel 2 in the way same as shown in FIG. 7.

The outer areas 13*a*, 13*b*, 13*c* are necessary for applying a uniform tension to the entire area of the beam-selecting area 12 that is to be a shadow mask 9 when the planar member 11 is pulled at four sides. Thus, generation of wrinkles due to a tension imbalance is suppressed in the beam selecting portion 12 (shadow mask 9).

In addition, the width of the bridge portion is increased along an arc line to connect to the second band frame portion 14*a*. If the connection part of the bridge portion 14*c* was not reinforced as mentioned above, i.e., width of the bridge portion 14*c* did not increase to connect to the second band frame portion 14*a*, stress would concentrate at the connecting part of the bridge portion 14*c* with the second band frame portion 14*a* and cause a breakage at this part.

Since the connection part of the bridge portion is reinforced as mentioned above in this embodiment, stress concentration at the connection part is relieved. As a result, breaking at the connection part is prevented when a tension is applied to the planar member.

If the radius of the arc along which the width of the bridge portion increases is too small, the concentration of the stress at the connection part is not relieved effectively. On the contrary, if the radius of the arc is too large, the purpose of the outer areas with apertures, that is to apply uniform tension to the entire area of the beam-selecting area 12, may not be performed.

In an example, the radius of the arc was 6 mm. The size of the fluorescent screen 4 was approximately 260 mm×330 mm, the outer dimension of the planar member was approximately 380 mm×450 mm, the beam-selecting area 12 of the planar member 11 was approximately 240 mm×320 mm, and the width of the first and second band frame portion 14*b*, 14*a* and bridge portion 14*c* was 10 mm.

The size and pitch of the apertures that are arranged in the outer areas 13*a*, 13*b* and 13*c* are preferably selected so that the outer areas 13*a*, 13*b* and 13*c* have the substantially same or a slightly larger tensile strength than the beam-selecting area 12. In an example, the outer area 13*a* had a tensile strength substantially the same as the beam-selecting area 12. The outer area 13*b*, 13*c* had a tensile strength substantially the same as the beam-selecting area 12 in the area closer to the center vertical axis 15, and had a larger tensile strength than the beam-selecting area 12 in the area far from the vertical center axis 15.

More specifically, the beam-selecting area 12 and outer area 13*a* had a vertical aperture pitch of 0.29 mm, a horizontal aperture pitch of 0.24 mm and an aperture size of 0.25×0.05 mm in the area near to the vertical axis 15, while they had a vertical aperture pitch of 0.29 mm, a horizontal aperture pitch 0.25 mm and an aperture size of 0.25×0.06 mm in the area far from the vertical axis 15.

The outer area 13*b*, 13*c* had a vertical aperture pitch of 0.29 mm, a horizontal aperture pitch 0.24 mm and an aperture size of 0.25×0.05 mm in the area closer to the vertical axis 15, while they had a vertical aperture pitch of 0.29 mm, a horizontal aperture pitch 0.24 mm and an aperture size of 0.05×0.05 mm in the area far from the vertical axis 15.

Figure 5A:
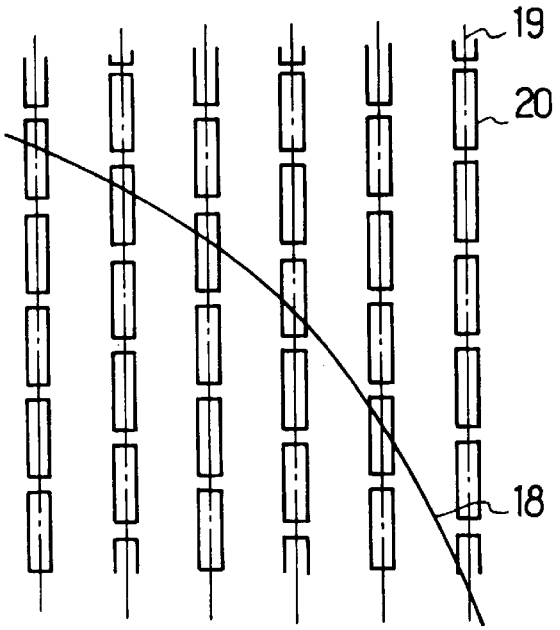
FIGS. 5A and 5B show an example of method for increasing the width of the bridge portion at the part connecting to the second band frame portion along an arc line.
Figure 5B:
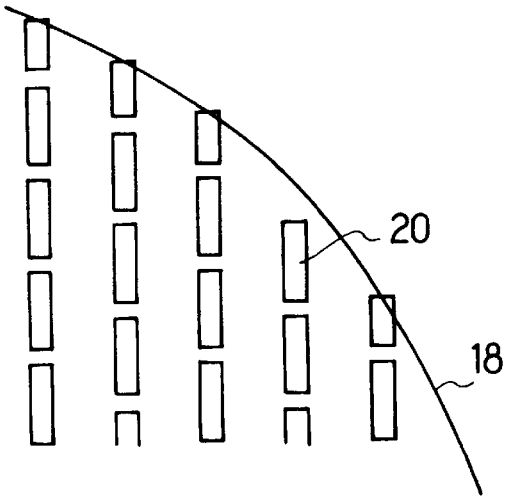

A concrete method for increasing the width of the bridge portion along an arc at the connecting portion with the second band frame portion is shown in FIGS. 5A and 5B. As shown in FIG. 5A, small slots 20 are arranged in a predetermined pitch and pattern, which are exaggerated in the figure. In order to increase the width of the bridge portion 14*c* along the arc line 18, slots 20 in the upper-right area with respect to the arc line 18 are filled up. Each slot 20 on the arc line 18 is also filled up in the upper part of the slot from the horizontal line at the intersection point of the vertical center axis 19 of the slot 20 with the arc line 18. If the remaining vertical dimension of the aperture after filling up the upper part is less than 0.05 mm, the whole slot is filled up. Thus, the width of the bridge portion 14*c* increases along the arc line as shown in FIG. 5B, where the right side of the arc line 18 is the bridge portion 14*c*.

Using the above-mentioned planar member 11 for a shadow mask, the percentage of defective parts in the process in which the planar member is welded to the frame member 7 under tension was 2%. On the other hand, the percentage of defective parts was 15% when using a planar member whose bridge portion 14*c* connects to the second band frame portion 14*a* without increasing its width.

In the above-mentioned example, the radius of the arc 18 was 6 mm, but this value should be selected in accordance with the size of the cathode-ray tube or other dimensions since the size of the planar member and a tension to be added to the member depend on the size of the cathode-ray tube. The arc line, along which the width of the bridge portion 14*c* increases, can be replaced with other curves. Alternatively, the width of the bridge portion 14*c* may increase linearly as shown in FIG. 2.

Figure 2:
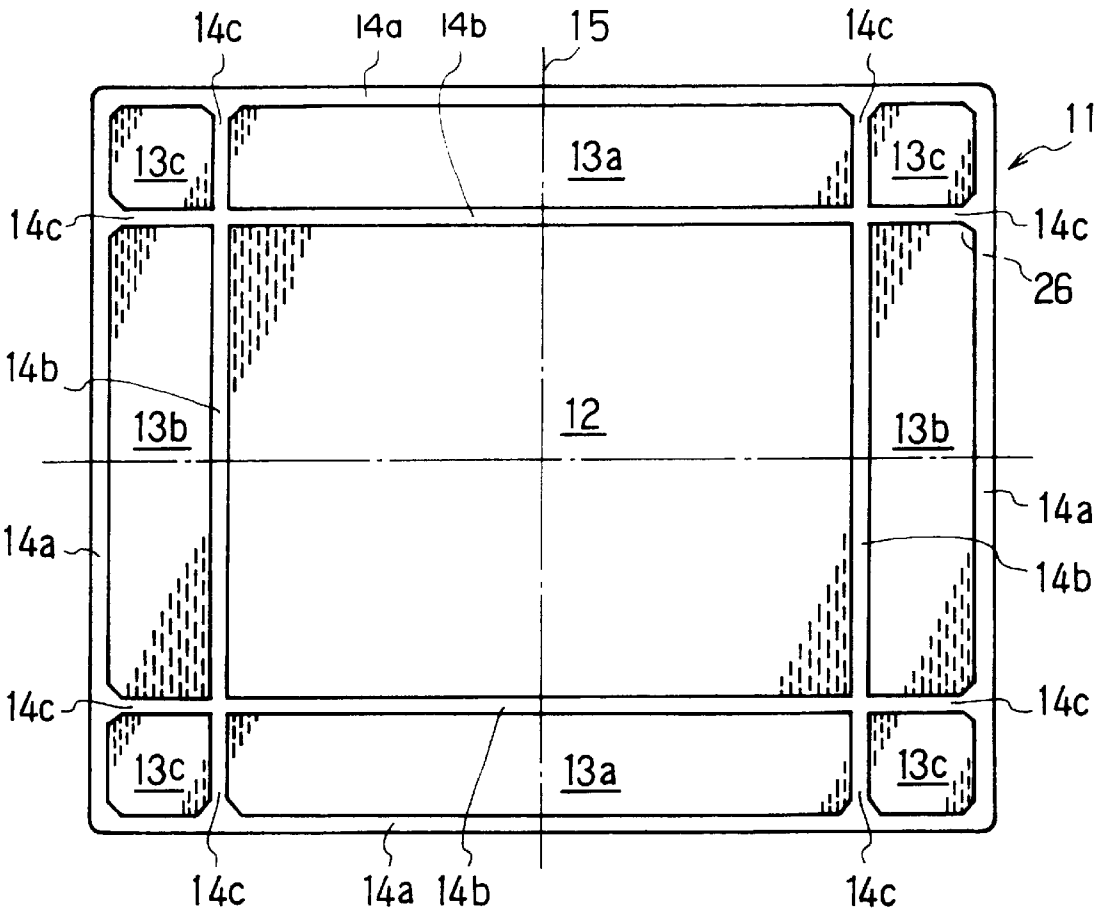
FIG. 2 is a plan view showing a variation of the planar member for a shadow mask of FIG. 1.

The planar member 11 of FIG. 2 is different from that of FIG. 1 only in the shape of the connection part of the bridge portion 14*c* with the second band frame portion 14*a*. In other words, the corners of the outer areas 13*a*, 13*b* and 13*c* adjacent to the second band frame portion 14*a* have a rounded shape in FIG. 1, while they have a linear cut shape in FIG. 2. The bridge portion 14*c* of the embodiment shown in FIG. 2 also is reinforced at the connecting part with the second band frame portion 14*a*, since the width of the bridge portion 14*c* increases gradually to connect with the second band frame portion 14*a*. Therefore, the embodiment of FIG. 2 has the advantage same as the embodiment of FIG. 1.

Second Embodiment

Figure 3:
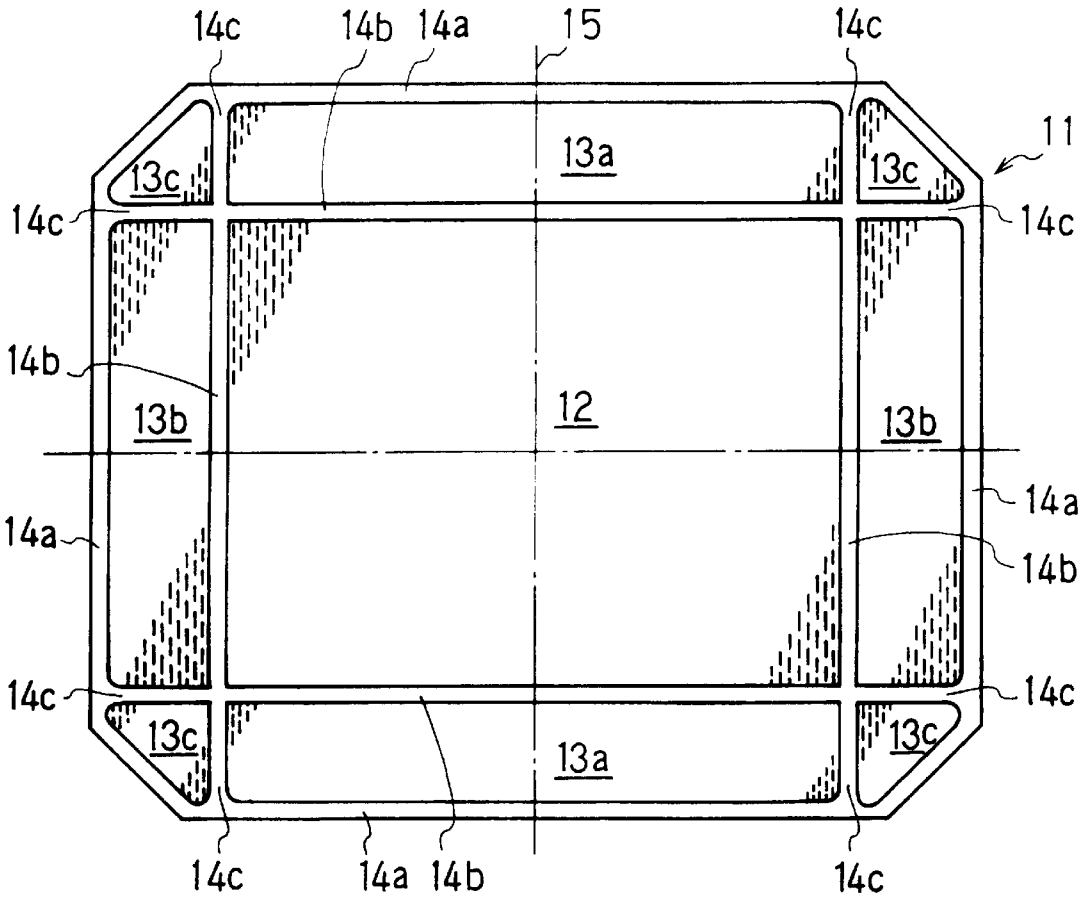
FIG. 3 is a plan view of a planar member for a shadow mask according to a second embodiment of the present invention.

FIG. 3 shows a planar member 11 for a shadow mask according to a second embodiment of the present invention. This embodiment is different from the first embodiment shown in FIG. 1 in that the second band frame portion 14*a* has an octagonal shape and the four outer corner areas 13*c* have a substantially triangular shape. Other portions and areas have the same shape as the first embodiment.

When the planar member 11 of this embodiment shown in FIG. 3 is used, the same effect can be obtained as the planar member shown in FIG. 1. In addition, the planar member 11 in FIG. 3 can relieve the concentration of a stress at the corner portion of the planar member more effectively than the planar member shown in FIG. 1 when the four sides of the planar member are pulled to the outside. As a result, the planar member is reinforced at the four corners. Thus, the planar member shown in FIG. 3 is hard to break and applies a uniform tension over the whole area of the beam-selecting area 12.

In this embodiment too, the width of the bridge portion 14*c* is increased gradually along an arc to connect with the second band frame portion 14*a* similarly to the first embodiment. The arc line can be replaced with other similar curves or a straight line as shown in FIG. 2

Third Embodiment

Figure 6:
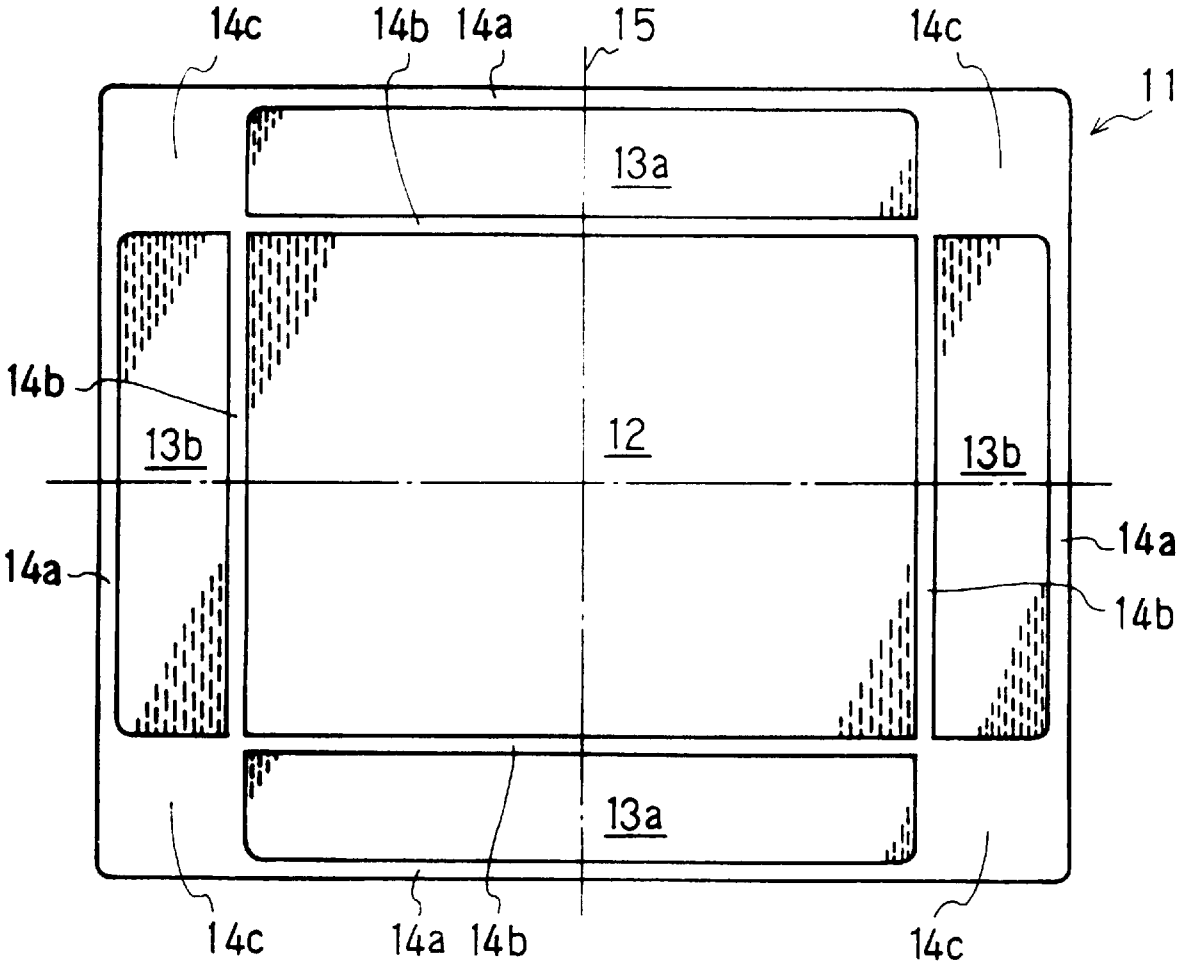
FIG. 6 is a plan view of a planar member for a shadow mask according to a third embodiment of the present invention.

FIG. 6 shows a plan view of a planar member 11 for a shadow mask according to a third embodiment of the present invention. This embodiment is different from the first embodiment of FIG. 1 in that the four corner portions have no apertures. In other words, the planer member 11 of this embodiment has no outer corner area 13*c* with a lot of apertures, which exists in the embodiment of FIG. 1. The first and second band frame members 14*b*, 14*a* are connected by wide bridge portions 14*c* at the four corners. This embodiment, which has no outer corner area with apertures, can provide the same effect as the above-mentioned embodiments, since there are outer areas 13*a*, 13*b* with apertures on four sides.

Moreover, the planar member 11 of this embodiment has bridge portions 14*c* whose connecting part with the second band frame portion 14*a* increases its width along an arc. In other words, the corners of the outer areas 13*a*, 13*b* adjacent to the second band frame portion 14*a* have arc shapes. As a result, stress concentration in the corners of the outer areas 13*a*, 13*b* adjacent to the second band frame portion 14*a* is relieved, so that breakage is prevented from occurring in these corners. The shape of these corners is not limited to an arc, but may be a similar curve or a straight line.

The second embodiment shown in FIG. 3 can be combined with this embodiment. In the planar member 11 shown in FIG. 3, the apertures in the four triangular outer corner portions 13*c* may be filled up. Then, the outer corner portions 13*c* may be replaced with wide bridge portions 14*c*. In this case too, the effect similar to that of the planar member 11 shown in FIG. 6 can be obtained.

As mentioned above, the planar member for a shadow mask and the method for manufacturing a shadow mask using the planar member according to the present invention can suppress the generation of wrinkles at corners of the beam-selecting area with beam passing apertures arranged at a predetermined pitch and pattern when the planar member is pulled at four sides to be provided with tension and is welded to the frame member. In addition, the stress concentration at the connecting part of the bridge portion with the outer (second) band frame portion is relieved so that a breakage is prevented from occurring in this connecting part.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

We claim:

1. A planar member for forming a shadow mask of a cathode-ray tube, comprising:

a beam-selecting area having a plurality of beam-passing apertures arranged in a predetermined pitch and pattern;

a first band frame portion surrounding the beam-selecting area;

a second band frame portion disposed around and spaced from the first band frame portion;

a plurality of bridge portions bridging an outer rim of the first band frame portion and an inner rim of the second band frame portion at plural points; and a plurality of outer areas with plural apertures, defined by the first and second band frame portions and two bridge portions, wherein the width of the bridge portion increases gradually so that the areas outside the beam-selecting area are reinforced gradually in directions in which the planar member for forming a shadow mask is pulled.

2. The planar member for a shadow mask according to claim 1, wherein the width of the bridge portion increases linearly to connect with the second band frame portion.

3. The planar member for a shadow mask according to claim 1, wherein the width of the bridge portion increases along an arc to connect with the second band frame portion.

4. The planar member for a shadow mask according to claim 1, wherein the first and second band frame portions have substantially rectangular configuration, and substantially rectangular outer corner areas with plural apertures are defined by the second band frame portion and two bridge portions.

5. The planar member for a shadow mask according to claim 1, wherein the first band frame portion has a substantially rectangular configuration, the second band frame portion has a substantially octagonal configuration, and substantially triangular outer corner portions with plural apertures are defined by the second band frame portion and two bridge portions.

6. The planar member for a shadow mask according to claim 1, wherein the size of the plural apertures in the outer areas is smaller in an area near to the second band frame portion than an area near to the first band frame portion.

7. A method for manufacturing a shadow mask, comprising the steps of:

preparing a planar member for a shadow mask, the planar member including, a beam-selecting area having a plurality of beam-passing apertures arranged in a predetermined pitch and pattern, a first band frame portion surrounding the beam-selecting area, a second band frame portion disposed around and spaced from the first band frame portion, a plurality of bridge portions bridging an outer rim of the first band frame portion and an inner rim of the second band frame portion at plural points, the connecting part of the bridge portion with the second band frame portion being reinforced in such a way that the width of the bridge portion increases gradually to connect with the second band frame portion, and a plurality of outer areas with plural apertures, defined by the first and second band frame portions and two bridge portions;

applying a tension to the planar member by pulling the four sides of the planar member outward;

welding the first band frame portion of the planar member to a metal frame member; and removing the outer part of the planar member around the welded portion.

8. The method according to claim 7, wherein the width of the bridge portion increases linearly to connect with the second band frame portion.

9. The method according to claim 7, wherein the width of the bridge portion increases along an arc to connect with the second band frame portion.

10. The method according to claim 7, wherein the first and second band frame portions have a substantially rectangular configuration, and substantially rectangular outer corner portions with plural apertures are defined by the second band frame portion and two bridge portions.

11. The method according to claim 7, wherein the first band frame portion has a substantially rectangular configuration, the second band frame portion has a substantially octagonal configuration, and substantially triangular outer corner portions with plural apertures are defined by the second band frame portion and two bridge portions.

12. The method according to claim 7, wherein the size of the plural apertures in the outer areas is smaller in an area near to the second band frame portion than an area near to the first band frame portion.

13. A method for manufacturing a cathode-ray tube, comprising the steps of:

preparing a planar member for a shadow mask, the planar member including, a beam-selecting area having a plurality of beam-passing apertures arranged in a predetermined pitch and pattern, a first band frame portion surrounding the beam-selecting area, a second band frame portion disposed around and spaced from the first band frame portion, a plurality of bridge portions bridging an outer rim of the first band frame portion and an inner rim of the second band frame portion at plural points, the connecting part of the bridge portion with the second band frame portion being reinforced in such a way that the width of the bridge portion increases gradually to connect with the second band frame portion, and a plurality of outer areas with plural apertures, defined by the first and second band frame portions and two bridge portions;

applying a tension to the planar member by pulling the four sides of the planar member outward;

welding the first band frame portion of the planar member to a metal frame member;

removing the outer part of the planar member around the welded portion to obtain the shadow mask; and attaching the shadow mask inside a glass panel of a cathoderay tube.

* * * * *